United States Patent [19]

Robertson

[11] 4,068,938

[45] Jan. 17, 1978

[54] ELECTROSTATIC COLOR PRINTING UTILIZING DISCRETE POTENTIALS

[75] Inventor: Robert Robertson, London, England

[73] Assignee: Rank Xerox Ltd., London, England

[21] Appl. No.: 587,479

[22] Filed: June 16, 1975

[30] Foreign Application Priority Data

Sept. 24, 1974 United Kingdom ..... 41465/74

[51] Int. Cl.[2] ..... G03G 15/01; G03G 15/10

[52] U.S. Cl. ..... 355/4; 118/645

[58] Field of Search ..... 355/4, 10; 118/645

[56] References Cited

U.S. PATENT DOCUMENTS

| | | | |
|---|---|---|---|
| 3,574,456 | 4/1971 | Grace | 355/4 |
| 3,667,428 | 6/1972 | Smith | 355/10 X |
| 3,702,483 | 11/1972 | Fantuz zo | 355/4 X |

*Primary Examiner*—William M. Shoop
*Attorney, Agent, or Firm*—J. J. Ralabate; C. A. Green; H. Fleischer

[57] ABSTRACT

An apparatus in which an electrostatic latent image is developed simultaneously in two colors. A first portion of the latent image has a potential greater than a first threshold with a second portion thereof having a potential less than a second threshold. The second threshold is less than the first threshold. Particles of a first color are applied to the first portion of the latent image with particles of a second color being applied to the second portion of the latent image. The electrostatic latent image is discharged to a potential less than the second potential and portions thereof having a potential greater than the second threshold by a pre-selected level.

11 Claims, 1 Drawing Figure

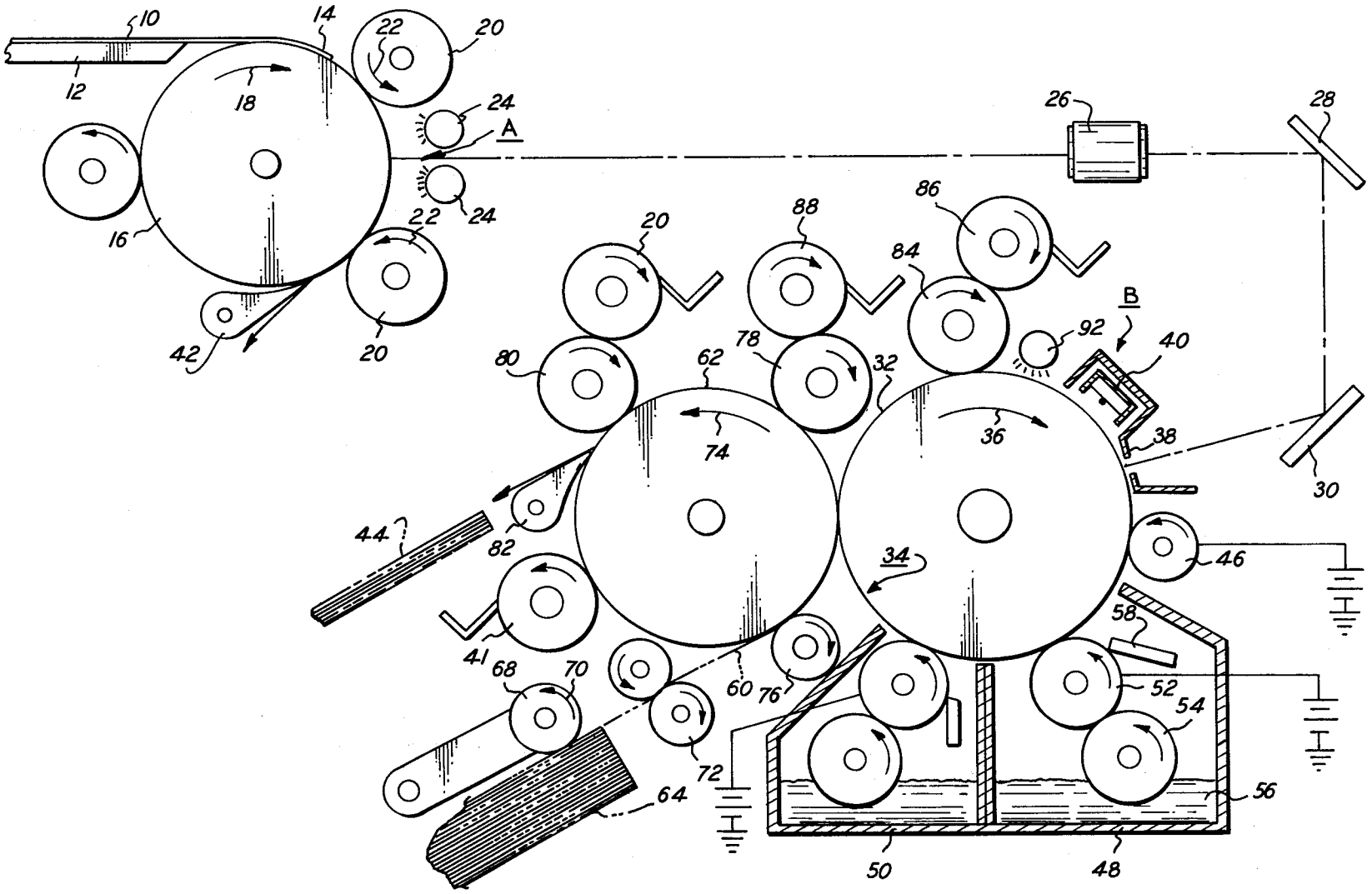
28
30
26
46
56
54
52
58
48
40
38
B
92
36
86
84
34
32
50
88
78
76
60
62
74
72
64
20
80
82
41
68
70
44
24
A
22
14
18
42
10
12
16

ELECTROSTATIC COLOR PRINTING UTILIZING DISCRETE POTENTIALS

BACKGROUND OF THE INVENTION

This invention relates generally to an electrophotographic printing machine, and more particularly concerns a color electrophotographic printing machine adapted to reproduce an original document containing two colors therein.

The process of electrophotographic printing comprises exposing a charged photoconductive member to a light image of an original document. The irradiated areas of the photoconductive surface are discharged, recording thereon an electrostatic latent image corresponding to the original document. A development system, thereupon, moves the developer mix of carrier granules and toner particles into contact with the photoconductive surface. The toner particles are attracted electrostatically from the carrier granules to the latent image forming a toner powder image. Thereafter, the toner powder image is transferred to a sheet of support material. After the toner powder image has been transferred to the sheet of support material, the sheet of support material advances to a fuser which permanently affixes the toner powder image thereto.

The foregoing briefly describes the basic concept of electrophotographic printing. Color electrophotographic printing utilizes this process to create successive, single color light images which, in turn, records single color electrostatic latent images on the photoconductive surface. These latent images are developed with toner particles complementary in color to the single color light image. The toner powder images are transferred to the sheet of support material in superimposed registration with one another forming a color copy corresponding to the original document. This is a subtractive system. Because of the inherent limitations found in most known colorants, it is generally necessary to employ costly and complex masking and/or balancing techniques to achieve a faithful color reproduction. Furthermore, because of the number of exposure and transfer operations involved, registration is frequently a problem in this type of system.

Many important applications of color do not require high fidelity. These are applications wherein color is employed functionally rather than esthetically, e.g. to distinguish, to contrast, or to emphasize as in diagrams, accounts or reports. In such applications, the only requirement is that the colors utilized may be easily and readily distinguishable from one another. Accurate matching and small differences are not significant. In these situations, a numerous choice of colors is not required. The color requirement is usually limited to two contrasting colors, i.e. blue and red, or black and red, etc. These colors will suffice in many applications, such as to distinguish profit and loss in accounting, to highlight amendments to a drawing or to a draft, and to emphasize points in a report. Such use is compatible with conventional typewriter machines utilizing two color ribbons and other convenient office practices.

Accordingly, it is a primary object of the present invention to improve electrophotographic printing by reproducing a copy of an original document in two colors when said colors are easily and readily distinguishable from one another.

SUMMARY OF THE INVENTION

Briefly stated, and in accordance with the present invention, there is provided an apparatus for rendering visible an electrostatic latent image.

Pursuant to the features of the present invention, the electrostatic latent image has a first portion with an image potential greater than a first threshold and a second portion with an image potential less than a second threshold. The second threshold is less than the first threshold. A developer unit applies particles of a first color to the first portion of the electrostatic latent image, and particles of a second color to the second portion of the electrostatic latent image.

BRIEF DESCRIPTION OF THE DRAWING

Other objects and advantages of the present invention will become apparent upon reading the following detailed description and upon reference to the drawing in which the FIGURE illustrated is a schematic view depicting an electrophotographic printing machine incorporating the features of the present invention therein.

While the present invention will be described in connection with the preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of the disclosed color electrophotographic printing machine of the present invention, the general operation and theory thereof will be initially discussed. Thereafter, the drawing will be referenced to describe the specific operation of one embodiment and or alternate thereto developed to achieve the concept described.

In choosing the original document for reproduction, the pairs of colors must be choosen with regard to the response characteristics of the photoconductive surface so that when applied at densities approaching saturation the corresponding electrostatic latent image is characterized by three well separated levels of potential, i.e. a high level corresponding to locally uniform areas of one color, an intermediate level corresponding to locally uniform areas of the other color, and a low level corresponding to locally uniform areas of the background. The intermediate level is preferably about mid-way between the high and low levels.

It is convenient to rate the colors in accordance with their densities or ability to absorb light relative to the background. The density of the dark color should be as great as is feasible under the circumstances. In practice, the dark color should have a density of not less than 0.9. The light color should then preferably correspond to a density of about 0.3. These densities correspond to effective reflectances of about $\frac{1}{8}$ and about $\frac{1}{2}$, respectively.

Since white paper is normally used as the background, its density should approach 0.0 and since white absorbs very little light, its effective reflectance should approach 1.

A convenient photoconductive surface, such as amorphous selenium, is typically most responsive at the blue end of the spectrum but relatively non-responsive at the red end. Thus, the foregoing criteria can be readily satisfied for either black and blue, or blue and red as dark and light color pairs.

In operation, the magnitude and polarity of the threshold potential for each development unit is adjustable. Hence, the threshold for the development unit applying the first color particles is set so that the particles are attracted to the areas of the electrostatic latent image corresponding to the dark color of the original. With regard to the areas corresponding to the light area and background, no particles are attracted thereto. Thus, the threshold is set so that the particles are only attracted to the area of the electrostatic latent image corresponding to the dark color and the color of the particles may correspond to the dark color as well. The threshold of the second developer unit is set so that the second color particles are applied to areas corresponding to the background of the original. These particles are not attracted to areas corresponding to the light and dark areas of the electrostatic latent image. This results in a copy in which the dark color of the original is rendered visible by the first color particles and the background of the original by the second color particles. The light color of the original remains the color of the sheet of support material serving as the copy sheet. The colors of the original document can be matched in the copy by having the sheet of support material correspond to the second color of the original document. In this way, the first color particles correspond to the dark color of the original document and the second color particles correspond to the background color of the original document. The resultant copy produced from particles having the foregoing colors corresponds to the original document.

In the alternative, the first and second color particles may correspond directly to the dark and light colors of the original document, respectively. Under these circumstances, the colors of the copy will be reversed from the colors of the original document, i.e., the dark color corresponding to the color of the first particles, the light color corresponding to the background color of the copy sheet, and the background color corresponding to the color of the second particles. However, this may be easily remedied by utilizing this copy as an intermediate to form a second copy. When the second copy is formed from the foregoing intermediary the resultant colors will correspond to the original document.

As can be seen by reference to the foregoing examples the first color particles are applied to the high level potential corresponding to the locally uniform areas of the dark color of the color pair and the second color particles are applied to the low level potential corresponding to the locally uniform areas of the white background with the intermediate level potential corresponding to the second color of the original receiving no colored particles.

In one embodiment of the electrophotographic printing machine hereinafter to be described, the electrostatic latent image is selectively discharged prior to development. The latent image is discharged such that any image potential greater than the background potential by a pre-selected level is discharged to a potential below that of the background, possibly even to a negative potential. This may be achieved by a discharge roller having a conductive surface maintained at a suitable potential and rolling over the electrostatic latent image prior to the application of the charged particles. The image is then discharged only at points where the electrostatic field between it and the approaching roller exceed the dielectric strength of air. At these points it is discharged below the threshold value. This field is determined by the potential difference between the image and the roller. Thus, the image is only discharged when this difference exceeds a critical value while differences in excess thereof are reduced a value below it. This critical value varies somewhat with constructional details, such as the thickness and dielectric constant of the photoconductive surface. However, typically about a 600 volt difference will result in those portions of the image being discharged to a potential below the background. The correct potential to be applied to the discharge roller is readily determined by experimentation. Each discharge roller will, in general, require its own biasing level as variations corresonding to when the discharge takes place and the strength of the developed image are determining criteria. The potential of the discharge roller is then adjusted to optimize the balance of the two development units employed. The dark color of the original is then rendered visible by the second color particles and the light color by the first color particles.

For purposes of convenience, the image areas may be designated as charged or discharged according to whether their potential is greater or less than a stipulated threshold value and to describe development as "direct" or "reversal" according to whether the particles are applied to a charged or discharged area. The first color particles then affect a direct development while the second color particles affect a reversal development.

Methods of development suitable for such an electrophotographic printing machine are well known in the prior art. These are characterized by the employment of a development electrode. The electrode is a conductive surface positioned adjacent to and spaced from the photoconductive surface and maintained at a desired potential level. Development is in response to the electrostatic field in the gap between the surfaces, with a threshold corresponding to some particular value of this field. The field effective for development is the sum of the fields in the gap due to the image charges and to the potential applied to the electrode, each acting alone. The proximity of the electrode strengthens the field due to the image charges and improves its correspondence to them while the potential of the electrode can be said to establish any desired correspondence between the image field and the development threshold.

It is well-known to effect development by maintaining a flow of charged particles through the gap. Development then follows the forces exerted by the charges by the development field with development being direct or reversal according to the polarity of the particles, i.e. that is opposite to or the same as the polarity of the image charges. Frequently, the developer mix comprises carrier granules and toner particles. The carrier granules serve to transport and to charge the particles, their polarity being determined by the formulation of the developer mix with the development threshold corresponding to the field necessary to detach them from the carrier. To be useful, the carrier must be compatible with the close spacing between the development electrode and photoconductive surface, to assure strong development in areas of uniform charge. In addition, the construction of the development stations must be compatible with the need for two of them. Also, following the development step, the developed image will be transferred to the sheet of support material. In view of the fact that the particles may have different polarities, this precludes electrostatic transfer to the sheet of support material. In lieu thereof, transfer may be achieved by simple contact or pressure. If the photoconductive surface is the surface upon which the charged particles are to remain, transfer is not required.

A cascade system might be employed which moves the developer mix in an upwardly direction and then allows it to descend into the gap between the development electrode and photoconductive surface rendering the latent image visible. An alternate approach would be to utilize the magnetic brush system which would be electrically biased to a suitable potential. Under these circumstances a directional flux field would be formed creating a brush of developer mix which contacts the electrostatic latent image. The latent image attracts the toner particles from the carrier granules rendering it visible.

An alternate method of development in which charged particles might be utilized is known as electrophoretic development. This employs a developer mix comprising an electrophoretic suspension of fine particles of pigment in a highly insulating liquid carrier. The particles are charged and the polarity is determined by the formulation of the developer mix. Each developer unit would comprise a container for the developer mix with an applicator in the form of a roller adapted to apply a thin film of the developer mix to the photoconductive surface. The applicator roll also serves as a development electrode in that its surface is conductive and adapted to be held at any desired potential level. The photoconductive surface may be a sheet of sufficiently conductive paper coated with the photoconductive layer, as for example a layer of zinc oxide in a binder material. Following development, the sheet may be squeegeed and warmed to dispel excessive liquid and the pigment permanently afixed to its surface. The print upon the sheet of coated paper is the output from the electrophotographic printing machine.

The present invention is not, however, dependent upon the use of development system having independently charged particles. In the preferred development apparatus, the particles are simply a liquid ink which may be pigmented or dyed. This ink is applied by means of a roller having a conductive surface serving also as a develoment electrode. The conductive surface is finally corrugated by a pattern of closely pitched spiral grooves and corresponding crests. The ink is first applied to coat the surface which is then scrapped with a doctor blade adapted to wipe the ink off the crest and to dress that in the grooves to a lower level. The crests then contact the photoconductive surface and roll over it. The ink is not independently charged but is polarized by the development field resulting in the appearance of induced charges over the surface with corresponding electrostatic forces. These are always attractive regardless of the direction of the field. The prior dressing of the ink to below the crests of the applicator serves to keep the ink off the photoconductive surface except where the development field is of sufficient magnitude to draw the ink up into contact. This determines the development threshold. The magnitude of the development threshold, and also that of the field corresponding to strong development, depends upon the magnitude and effective duration of the attractive forces and upon the rate of response of the ink. Thus, the magnitude of development can be varied by changing the speed of operation and the mechanical and electrical characteristics of the ink.

The ink is always attracted regardless of the direction of the development field. If this lies between equal but opposite limits corresponding to the development threshold, the attraction is ineffective and development is prevented. Beyond these limits, development is direct or reversal according to the direction of the field. Thus, if the direction of field is the same or opposite to that of the field due to the image charge either direct or reversal development is achieved. In the present invention, the development field at threshold must be sufficiently large relative to the image field to assure that these regions are mutually exclusive. In practice, these thresholds are such that infringement of this condition is unlikely. Development is then exclusively direct or exclusively reversal with both its direction and its threshold determined by the potential applied to the electrode.

It is believed that the foregoing description is sufficient for purposes of the present application to describe the general theory of operation of the improved electrophotographic printing machine incorporating the features of the present invention therein.

Referring now to the drawing, the FIGURE depicts an electrophotographic printing machine adapted to reproduce a two color original document.

As shown in the FIGURE, original document 10 is positioned face upwards in input tray 12. The leading edge 14 of original document 10 is located closely adjacent to grippers (not shown) on the surface of drum 16. The circumference of drum 16 is sufficient to accommodate the longest document to be copied without the trailing edge of the document overlapping the grippers.

When the copying operation is initiated, the grippers on drum 16 secure leading edge 14 of the original document 10 thereto. Drum 16 rotates in the direction of arrow 18 at a substantially unifom angular velocity. This draws original document 10 onto its surface under rollers 20, rotating in the direction of arrow 22, past illumination station A. At illumination station A, lamps 24 illuminate document 10, and a flowing light image of document 10 is projected by lens 26 and mirrors 28 and 30 onto photoconductive surface 32 of drum 34. Drum 10 rotates in the direction of arrow 36 and the flowing light image is projected onto photoconductive surface in region 38 after charging thereof by corona generating device 40. The image projected onto the charged photoconductive surface is of a unit magnification.

Original document 10 is carried through illumination station A a number of times equal to the number of copies being made. Thereafter, pickup fingers 42 are released from their normal position spaced from drum 16 and move to an operative position in contact with document 10. Simultaneously therewith, the grippers release leading edge 14 of document 10 separating it from drum 16. As document 10 continues to be driven by rollers 20, leading edge 14 thereof is separated from drum 16 by fingers 42. Document 10 continues to be driven by rollers 20 into a collection tray 44.

Drum 34 rotates in synchronism with drum 16. Drum 34 has a photoconductive surface 32 secured thereto and entrained thereabout. Preferably, photoconductive surface 32 is made from a selenium alloy having a grounded conductive support such as aluminum. The surface is charged to a uniform potential as it passes beneath corona generating device 40 at charging station B. Thereafter, the charged portion of photoconductive surface 32 passes into exposure station A where it is irradiated by the flowing light image. The flowing light image selectively discharges the charge on photoconductive surface 32, recording an electrostatic latent image thereon.

In one embodiment of the present invention, the electrostatic latent image is formed only by exposing the charged photoconductive member to a light image of the original document, and discharging roller 46 is not in operation. The electrostatic latent image is then developed in two steps. Initially, particles in the form of liquid inks of first and second colors are applied thereto at development units 48 and 50. The development units are substantially identical, the only difference being in the color of the liquid ink contained therein. Hence, only one development unit, i.e. development unit 48, will be described in detail. At development unit 48, an applicator roll 52 is in rolling contact with photoconductive surface 32 of drum 34. Applicator roll 52 has a conductive surface maintained at the appropriate potential and formed with closely pitched spiral grooves. An ink supply roller 54 coats the grooved surface of applicator roller 52 with ink from a supply 56. A doctor blade 58 removes ink from the crests of applicator roller 52 and dresses the ink in the grooves thereof to a level below the crests.

The developed image is transferred by simple contact and pressure to a sheet of support material 60, i.e. paper, supported on drum 62. Support material 60 is advanced from a stack 64 by feeding mechanism 66. Feeding mechanism 66 includes roller 68 rotating in the direction of arrow 70 to advance the uppermost sheet from stack 64. The advancing sheet is moved between rollers 72. Rollers 72 move the sheet advancing therebetween to drum 64 where it is secured releasably thereon by grippers (not shown). Drum 62 rotates in the direction of arrow 74 drawing sheet 60 past idler rollers 76, 78 and 80. Drum 62 rotates at the same tangential velocity as drum 32. After the sheet of support material passes beneath idler roller 80, the gripper fingers release the sheet of support material so that it may be detached by pickoff fingers 82 therefrom. Pickoff fingers 82 guide the sheet of support material into tray 44. Idler roller 80 is positioned such that the passage of the sheet of support material is complete before the rotation of drum 16 for exposure of the next image, or in the case of the sheet bearing the last image of a document, the completion of the additional rotation of drum 16.

After its contact with drum 62, the surface of drum 32 is wiped clean by a cleaning roller 84 arranged to remove any remaining ink. Roller 86, having a scrapper and sump for collection of the removed ink, cleans roller 84. Similarly, rollers 88 and 90 are provided to clean idler rollers 78 and 80, respectively. A lamp 92 illuminates the cleaned surface of drum 32 to discharge any remaining charges thereon. Thereafter, photoconductive surface 32 passes to charging station B for the initiation of the next successive cycle.

When support material 60 in stack 64 is colored to the second color of the original document, the second ink when applied to support material 60 produces the background color of the original document. Thus, only one reproduction step is required, the original being fed from tray 12 around the drum a plurality of times to produce the required number of copies in tray 44.

When the double pass arrangement is employed, where an intermediary copy is made in which the second color and background color of the original become reversed, only one intermediary copy is made from the original. This intermediary copy is then copied in the printing machine a plurality of times to provide the required number of final copies; the double reversal of the second color and background color provides correspondence of the second and background colors between the original and the final copies.

In an alternate embodiment of the present invention, roller 46 is provided in the illustrated position in FIG. 1. The electrostatic latent image is selectively discharged before development as hereinbefore described. Roller 46 is electrically biased by a suitable voltage source so as to effectively discharge the electrostatic latent image in regions having an image potential greater than the background by a pre-selected level.

It should also be noted that applicator roller 52 of development unit 48 and the corresponding applicator roller of developer unit 50 are electrically biased by a voltage source to a suitable magnitude and polarity so as to develop the appropriate regions of the electrostatic latent image.

In recapitulation, the electrophotographic printing machine depicted in the drawings is adapted to produce two color copies from a two color original document. This is achieved by recording an electrostatic latent image having three discrete potential levels thereon. The high level is rendered visible by first color particles corresponding in color to the dark color of the original document and the low level or background level is developed by second color particles. The undeveloped region remains the color of the sheet of support material which may correspond to the second color of the original document.

Thus, it is apparent that there has been provided, in accordance with the present invention, an electrophotographic printing machine that fully satisfies the objects, aims and advantages hereinbefore set forth. While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. An apparatus for rendering visible an electrostatic latent image having a portion thereof with an image potential greater than a first threshold and a second portion thereof with an image potential less than a second threshold, the second threshold being less than the first threshold, wherein the improvement includes:

a developer unit applying particles of a first color to the first portion of the latent image and particles of a second color to the second portion of the latent image further including means for selectively discharging the electrostatic latent image to a potential less than the second threshold in portions thereof having a potential greater than the second threshold by a preselected level.

2. An apparatus as recited in claim 1, wherein said discharging means includes a conductive roller electrically biased to a preselected potential and magnitude.

3. An electrophotographic printing machine for reproducing an original document having a first color, a second color, and a background color therein, including:

a photoconductive member;

means for charging said photoconductive member to a substantially uniform potential;

means for projecting a light image of the original document onto the charged portion of said photoconductive member recording an electrostatic latent image having a first image potential corresponding to the first color, a second image potential less than the first image potential and corresponding to the second color, and a third image potential less than the second image potential and corresponding to the background color; and means for applying particles corresponding in color to the color of the first color of the original document to the portion of the electrostatic latent image having the first image potential and particles corresponding in color to the color of the background of the original document to the portion of the electrostatic latent image having the third image potential with the portion of the electrostatic latent image having the second image potential remaining void of particles.

4. A printing machine as recited in claim 3, further including means for transferring the particles from the electrostatic latent image recorded on said photoconductive member to a sheet of support material.

5. A printing machine as recited in claim 4, wherein the sheet of support material is of a color corresponding to the second color of the original document.

6. A printing machine as recited in claim 5, further including means for fixing substantially permanently th particles to the sheet of support material.

7. A printing machine as recited in claim 6, wherein said particle applying means includes:

a first grooved roller having a conductive surface electrically biased to the potential of sufficient magnitude and polarity so that uncharged liquid ink in the grooves below the crests thereof render the portion of the electrostatic latent image having the first image potential visible; and a second grooved roller having a conductive surface electrically biased to a potential of sufficient magnitude and polarity so that uncharged liquid ink in the grooves below the crest thereof renders the portion of the electrostatic latent image having the third image potential visible.

8. A printing machine as recited in claim 7, further including means for selectively discharging the electrostatic latent image to a potential less than the third image potential in portions having a potential greater than the third image potential by a preselected level.

9. A printing machine as recited in claim 8, wherein said discharging means includes a conductive roller electrically biased to a preselected potential and magnitude.

10. A printing machine as recited in claim 6, further including means for selectively discharging the electrostatic latent image to a potential less than the third image potential in portions having a potential greater than the third image potential by a preselected level.

11. A printing machine as recited in claim 10, wherein said discharging means includes a conductive roller electrically biased to a preselected potential and magnitude.

* * * * *